US011678115B2

(12) United States Patent
Li

(10) Patent No.: US 11,678,115 B2
(45) Date of Patent: Jun. 13, 2023

(54) PLAYBACK DEVICE AND CONTROL METHOD

(71) Applicant: MERRY ELECTRONICS (SHENZHEN) CO., LTD., Guangdong (CN)

(72) Inventor: Hung-Yuan Li, Taichung (TW)

(73) Assignee: MERRY ELECTRONICS (SHENZHEN) CO., LTD., Guangdong (CN)

( * ) Notice: Subject to any disclaimer, the term of this patent is extended or adjusted under 35 U.S.C. 154(b) by 139 days.

(21) Appl. No.: 17/151,684

(22) Filed: Jan. 19, 2021

(65) Prior Publication Data

US 2022/0078549 A1 Mar. 10, 2022

(30) Foreign Application Priority Data

Sep. 10, 2020 (TW) ..... 109131154

(51) Int. Cl.
*H04R 3/02* (2006.01)
*H04R 1/10* (2006.01)

(52) U.S. Cl.
CPC ..... *H04R 3/02* (2013.01); *H04R 1/1041* (2013.01)

(58) Field of Classification Search
CPC ..... H04R 3/02; H04R 1/1041
USPC ..... 381/93, 123, 94.5, 94.1, 94.6, 120, 150; 330/149
See application file for complete search history.

(56) References Cited

U.S. PATENT DOCUMENTS 6,741,099 B1 * 5/2004 Krugly ..... H03K 17/04123 326/82
7,187,774 B2 * 3/2007 Rashid ..... H03G 3/345 381/104
8,547,072 B2 * 10/2013 Obatake ..... G05F 1/455 323/212
2011/0096944 A1 * 4/2011 Chee ..... H03F 3/2173 330/9

OTHER PUBLICATIONS

Texas Instrument, TL7660 CMOS Voltage Converter Data Sheet, Jun. 2006. (Year: 2006).*

* cited by examiner

*Primary Examiner* — Vivian C Chin
*Assistant Examiner* — Con P Tran
(74) *Attorney, Agent, or Firm* — CKC & Partners Co., LLC

(57) ABSTRACT

A playback device includes a speaker, a controller, a first switch circuit, and a second switch circuit. The speaker has a first terminal and a second terminal. The controller is configured to output a first audio signal and a second audio signal. The controller is coupled to the first terminal of the speaker, and is configured to transmit the first audio signal to the speaker. The second switch circuit is coupled between the second terminal of the speaker and the controller, and is coupled to the first switch circuit. The second switch circuit is configured to transmit the second audio signal from the controller to the speaker when the first switch circuit is turned on.

9 Claims, 4 Drawing Sheets

PLAYBACK DEVICE AND CONTROL METHOD

RELATED APPLICATIONS

This application claims priority to Taiwan Application Serial Number 109131154, filed Sep. 10, 2020, which is herein incorporated by reference.

BACKGROUND

Technical Field

The present disclosure relates to a playback device and a control method. More particularly, the present disclosure relates to a playback device and a control method that reduce pop.

Description of Related Art

In the related art, an earphone will transmit an audio signal to a speaker through a control chip after receiving the audio signal. However, the moment the control chip starts or stops outputting the audio signal, pop is generated due to a surge, which affects the user's listening experience. Although the above problem can be resolved by disposing a processing circuit between the control chip and the speaker, power consumption is increased because of the complex processing circuit composed of multiple components. In addition, if the speaker operates in a single-ended mode where one terminal is grounded, noises are increased.

For the foregoing reasons, there is a need to solve the above-mentioned problems by providing a playback device and a control method.

SUMMARY

A playback device is provided. The playback device comprises a speaker, a controller, a first switch circuit, and a second switch circuit. The speaker has a first terminal and a second terminal. The controller is configured to output a first audio signal and a second audio signal. The controller is coupled to the first terminal of the speaker and is configured to transmit the first audio signal to the speaker. The second switch circuit is coupled between the second terminal of the speaker and the controller, and is coupled to the first switch circuit. The second switch circuit is configured to transmit the second audio signal from the controller to the speaker when the first switch circuit is turned on.

The present disclosure provides a control method. The control method comprises the following steps: using a controller to output a control signal and an output signal, wherein the output signal comprises a first audio signal and a second audio signal; controlling a switch circuit coupled between a speaker and the controller to be turned off according to the control signal before the controller outputs the output signal; controlling the switch circuit to be turned on according to the control signal after the controller outputs the output signal for a first predetermined time; and directly receiving the first audio signal from the controller by one terminal of the speaker, and receiving the second audio signal from the controller through the turn-on switch circuit by another terminal of the speaker.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

According to the usual mode of operation, various features and components/elements in the figures have not been drawn to scale, which are drawn to the best way to present specific features and components/elements related to the present disclosure. In addition, among the different figures, the same or similar element symbols refer to similar elements/components.

DESCRIPTION OF THE EMBODIMENTS

All terms used herein have their ordinary meanings. The above terms are defined in the commonly used dictionaries, and any examples of the use of the term discussed herein included in the description of the present specification are merely for illustrative purposes, and are not intended to limit the scope and meaning of the present disclosure. Similarly, the present disclosure is not limited to the various embodiments described in this specification.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure. It will be understood that, as used herein, the phrase "and/or" includes any and all combinations of one or more of the associated listed items.

In this document, the term "coupled" may also be termed as "electrically coupled," and the term "connected" may be termed as "electrically connected." "Coupled" and "connected" may mean "directly coupled" and "directly connected" respectively, or "indirectly coupled" and "indirectly connected" respectively. "Coupled" and "connected" may also be used to indicate that two or more components/elements cooperate or interact with each other.

Figure 1:
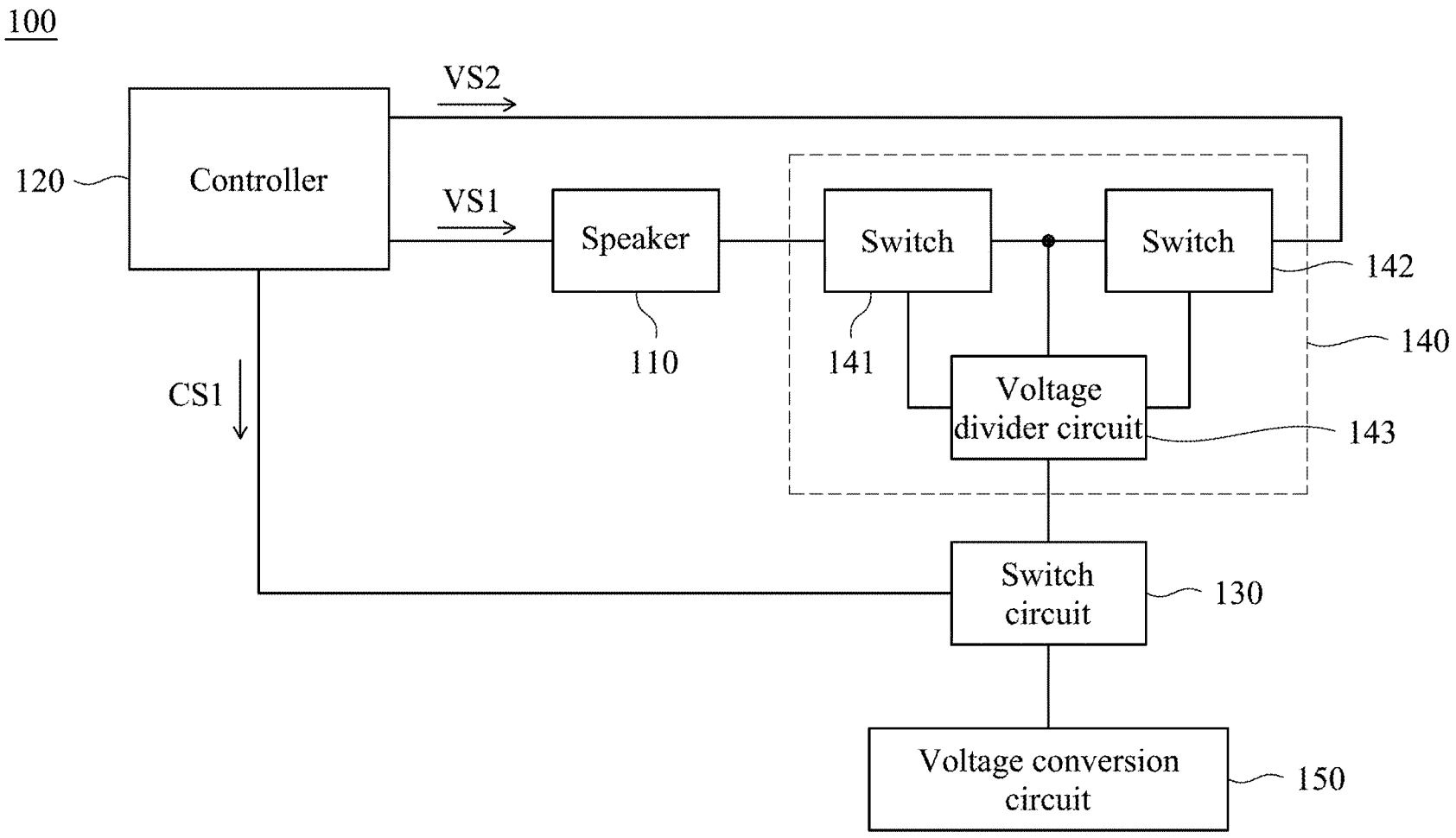
FIG. 1 depicts a schematic diagram of a playback device according to some embodiments of the present disclosure.

A description is provided with reference to FIG. 1. FIG. 1 depicts a schematic diagram of a playback device 100 according to some embodiments of the present disclosure. As shown in FIG. 1, the playback device 100 comprises a speaker 110, a controller 120, a switch circuit 130, and a switch circuit 140. One terminal of the speaker 110 is directly coupled to the controller 120, another terminal is coupled to the controller 120 through the switch circuit 140. In other words, the switch circuit 140 is coupled between the controller 120 and one of the terminals of the speaker 110. The switch circuit 130 is coupled between the controller 120 and the switch circuit 140.

In some embodiments, the controller 120 is configured to output an audio signal VS1 to a first terminal of the speaker 110. The first terminal of the speaker 110 is directly coupled to the controller 120. In some embodiments, the controller 120 is a Bluetooth chip comprising a signal decoder disposed on a wireless earphone. However, the present disclosure is not limited in this regard.

In some embodiments, the controller 120 is configured to output an audio signal VS2, and transmit the audio signal VS2 to a second terminal of the speaker 110 through the switch circuit 140 coupled between the second terminal of the speaker 110 and the controller 120. In some embodiments, the switch circuit 140 transmits the audio signal VS2 to the speaker 110 only when the switch circuit 130 is turned on.

In some embodiments, the audio signal VS1 and the audio signal VS2 are equal and inverted signals, thus enabling the speaker 110 to operate in a differential mode to avoid the noise problem occurring in a single-ended mode.

In greater detail, when the switch circuit 130 is in a turn-on state, the switch circuit 140 can allow a switch 141 and a switch 142 in the switch circuit 140 to have a sufficient voltage difference to satisfy a turn-on condition by receiving a voltage signal having a lower potential transmitted through the turned-on switch circuit 130. As a result, through controlling the switch circuit 130 to be turned on or turned off, the switch circuit 140 can be further controlled to be turned on or turned off. A detailed disposition method may be referred to the following paragraphs.

In some embodiments, the switch circuit 130 is controlled to be turned on or turned off according to a control signal CS1. In some embodiments, the control signal CS1 can be used to control the switch circuit 130 to be turned off before the controller 120 outputs the audio signal VS1 and the audio signal VS2, and the control signal CS1 is used to control the switch circuit 130 to be turned on after the controller 120 outputs the audio signal VS1 and the audio signal VS2 for a first predetermined time (for example: 1 second, but not limited to this, it can be adjusted depending on the control requirements of the earphone system).

In some embodiments, the control signal CS1 is output from the controller 120, and is received by using a control terminal of the switch circuit 130. In some embodiments, the control signal CS1 may be a digital signal or an analog signal.

With the above disposition, the switch circuit 140 is in a turn-off state at an instant of outputting the audio signal VS1 and the audio signal VS2 by the controller 120, so as to avoid receiving pop caused by a surge generated by the controller 120 at the instant of outputting signals.

In some embodiments, the switch circuit 140 comprises the switch 141 and the switch 142 coupled in reverse series. In some embodiments, the switch circuit 140 further comprises a voltage divider circuit 143 coupled between the switch 141 and the switch 142. A detailed circuit configuration may be referred to the following description.

Figure 2A:
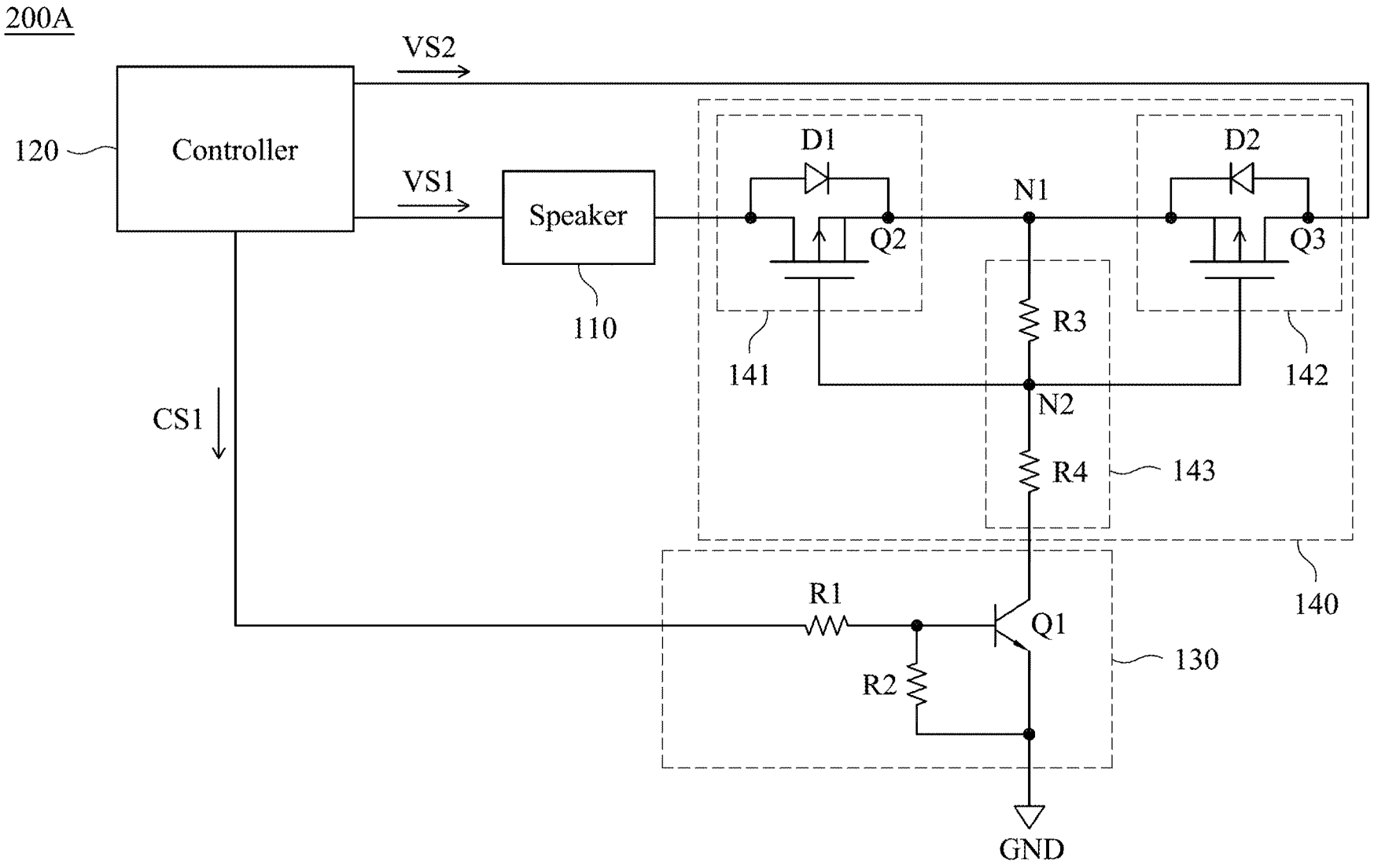
FIG. 2A depicts a schematic diagram of a playback device according to some embodiments of the present disclosure.

A description is provided with reference to FIG. 1 and FIG. 2A. FIG. 2A depicts a schematic diagram of a playback device 200A according to some embodiments of the present disclosure. As shown in FIG. 2A, the switch circuit 130 comprises a resistor R1, a resistor R2, and a transistor Q1.

In some embodiments, the transistor Q1 may be an NPN bipolar junction transistor (BJT). In the following, the transistor Q1 being the NPN BJT is taken as an example for illustration. However, the transistor Q1 may be other types of transistors in other embodiments. In addition, the switch circuit 130 may further comprise a number of transistors of various types coupled to each other. As long as they can be used as switches, it is within the scope of the present disclosure. The present disclosure is not limited to the above circuit elements and the elements shown in the figures.

In some embodiments, a first terminal (such as a collector terminal) of the transistor Q1 is coupled to the switch circuit 140. A second terminal (such as an emitter terminal) of the transistor Q1 is coupled to a ground terminal GND. The resistor R1 is coupled between the controller 120 and a control terminal of the transistor Q1. The resistor R2 is coupled between the control terminal and the second terminal of the transistor Q1. In some embodiments, the resistor R1 is 10 kiloohms (kΩ) and the resistance R2 is 100 kiloohms (kΩ).

In some embodiments, the switch 141 comprises a transistor Q2 and a diode D1 connected in parallel and coupled to each other, and the switch 142 comprises a transistor Q3 and a diode D2 connected in parallel and coupled to each other. In some embodiments, the transistor Q2 and the transistor Q3 may be P-type metal oxide semiconductor field effect transistors (MOSFET). In the following, the transistor Q2 and the transistor Q3 being the P-type MOSFETs is taken as an example for illustration. However, each of the transistor Q2 and the transistor Q3 may be other types of transistors in other embodiments. Additionally, each of the switch 141 and the switch 142 may further comprise a number of transistors of various types coupled to each other. As long as they can be used as switches, it is within the scope of the present disclosure. The present disclosure is not limited to the above circuit elements and the elements shown in the figures.

In some embodiments, the switch 141 is connected in reverse series with the switch 142 at a node N1. In other words, a source terminal of the transistor Q2 is coupled to a source terminal of the transistor Q3 at the node N1. In some embodiments, a control terminal (such as a control terminal of the transistor Q2) of the switch 141 is coupled to a control terminal (such as a control terminal of the transistor Q3) of the switch 142 at a node N2.

In some embodiments, anode terminals of the diode D1 and the diode D2 are respectively coupled to drain terminals of the transistor Q2 and the transistor Q3. Cathode terminals of the diode D1 and the diode D2 are respectively coupled to the source terminals of the transistor Q2 and the transistor Q3. In some embodiments, the diode D1 and the diode D2 are parasitic diodes, which can be used to avoid current leakages.

In some embodiments, the voltage divider circuit 143 coupled between the switch 141 and the switch 142 comprises a resistor R3 and a resistor R4. The resistor R3 is coupled between the node N1 and the node N2, and the resistor R4 is coupled between the node N2 and the switch circuit 130. The voltage divider circuit 143 can adjust voltages across the control terminals and source terminals (hereinafter referred to as Vgs) that the switch 141 and the switch 142 have by adjusting a ratio of the resistor R3 to the resistor R4. In some embodiments, the resistor R3 is 100 kiloohms (kΩ) and the resistance R4 is 10 kiloohms (kΩ).

With additional reference to FIG. 1, the playback device 100 further comprises a voltage conversion circuit 150 in some embodiments. The voltage conversion circuit 150 is configured to provide a negative voltage to the switch circuit 130. A detailed disposition method may be referred to the following paragraphs.

In greater detail, in some embodiments, when a voltage (for example: 1.5V) of the audio signal VS1 and the audio signal VS2 output from the controller 120 is higher than a threshold voltage (for example: 0.9V) of the switch 141 and the switch 142 in the switch circuit 140, the switch circuit 130 in the playback device 100 can be directly coupled to the ground terminal GND, so the switch circuit 140 can be controlled to turn on. On the contrary, in some embodiments, when the voltage (for example: 0.8V) of the audio signal VS1 and the audio signal VS2 output from the controller 120 can not overcome the threshold voltage (for example: 0.9V) of the switch 141 and the switch 142 in the switch circuit 140, it is necessary to couple the switch circuit 130 to the voltage conversion circuit 150. By using the voltage conversion circuit 150 to perform a conversion process on an input voltage signal, a voltage signal having the negative voltage is provided to increase the Vgs of the switch 141 and the switch 142 in the switch circuit 140. The Vgs is thus higher than the threshold voltage. In this manner, the switch circuit 140 is turned on.

Figure 2B:
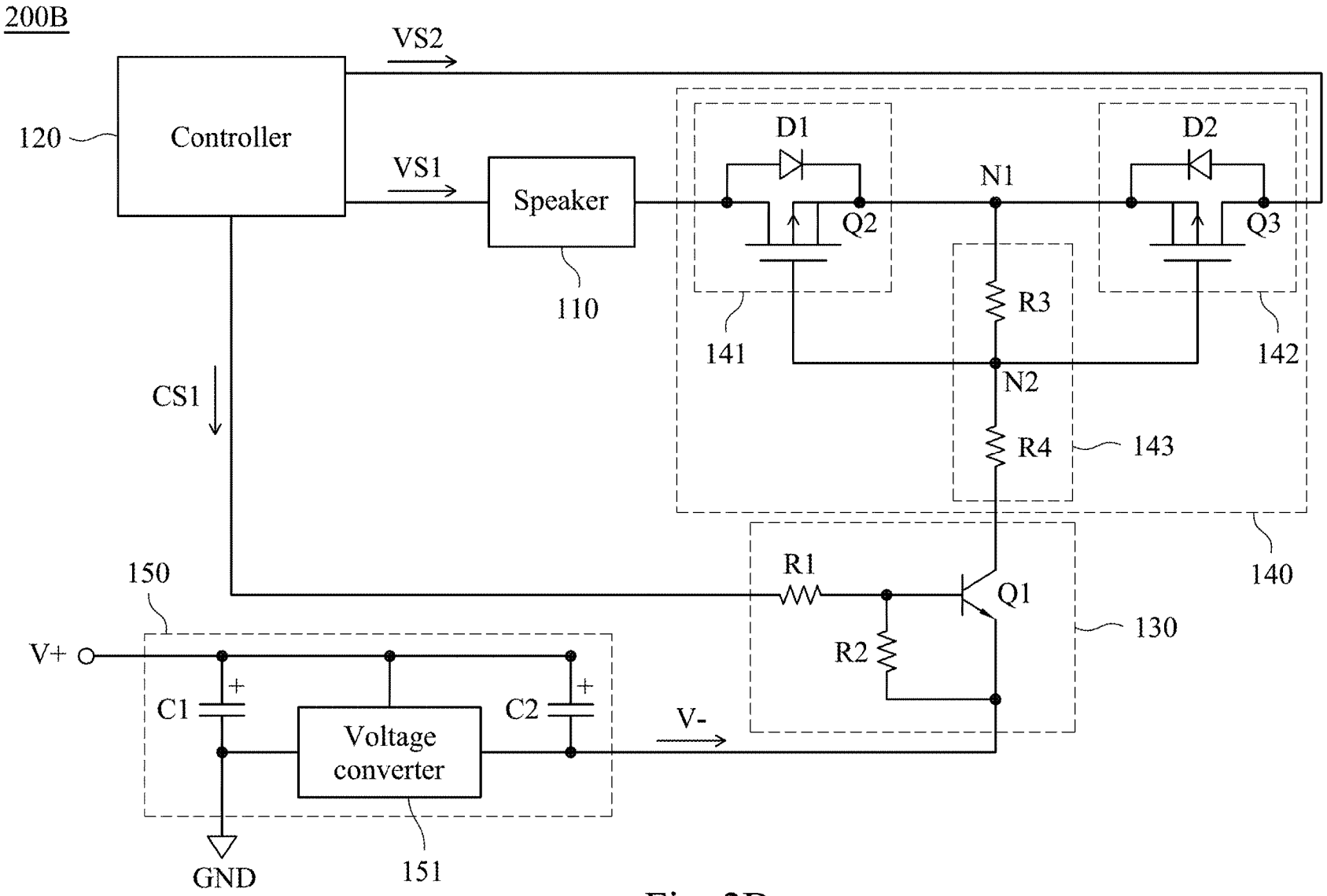
FIG. 2B depicts a schematic diagram of a playback device according to some embodiments of the present disclosure.

A description is provided with reference to FIG. 1 and FIG. 2B. FIG. 2B depicts a schematic diagram of a playback device 200B according to some embodiments of the present disclosure. FIG. 2B differs from FIG. 2A in that the playback device 200B in FIG. 2B further comprises the voltage conversion circuit 150 coupled to the switch circuit 130. In other words, the switch circuit 130 in FIG. 2B is not directly grounded. Except for the above difference, the rest of the playback device 200B is the same as the playback device 200A, and a description in this regard is not provided.

In some embodiments, the voltage conversion circuit 150 converts an input voltage, and transmits the converted voltage to the switch circuit 140 through the turn-on switch circuit 130 to control and turn on the switch circuit 140. In some embodiments, the voltage conversion circuit 150 provides an output voltage V− to the switch circuit 130 through using a received input voltage V+. When the switch circuit 130 is turned on, a switching signal is generated to the switch circuit 140 according to the output voltage V−, so that the switch circuit 140 is turned on correspondingly.

In some embodiments, the voltage conversion circuit 150 comprises a capacitor C1, a capacitor C2, and a voltage converter 151. The voltage converter 151 is configured to convert the input voltage V+ into the output voltage V−, and has an input terminal, an output terminal, and a ground terminal. The input terminal of the voltage converter 151 is coupled to the input voltage V+, the capacitor C1 is coupled between the ground terminal GND and the input terminal of the voltage converter 151, and the capacitor C2 is coupled between the input terminal and the output terminal of the voltage converter 151. In some embodiments, the voltage converter 151 can be adjusted to output the output voltages V− of different voltage magnitudes so as to match different negative voltage values required by the switch circuit 140. For example, the greater the absolute value of the output voltage V− is, the higher Vgs the switch circuit 140 can have.

It is noted that the audio signal VS1 and the audio signal VS2 in the above playback devices 100, 200A, and 200B are signals of a same ear canal (such as a left ear canal) output by the controller 120, and are output to a speaker on one side correspondingly. In some embodiments, the playback device 100 further comprises a speaker and switch circuits (not shown in the figure) corresponding to another ear canal (such as a right ear canal), and outputs another set of audio signals different from the audio signal VS1 and the audio signal VS2 to the corresponding speaker by using the corresponding switch circuits. Since the circuit corresponding to another ear canal has a disposition method similar to the above, a description in this regard is not provided here to simplify matters.

Figure 3:
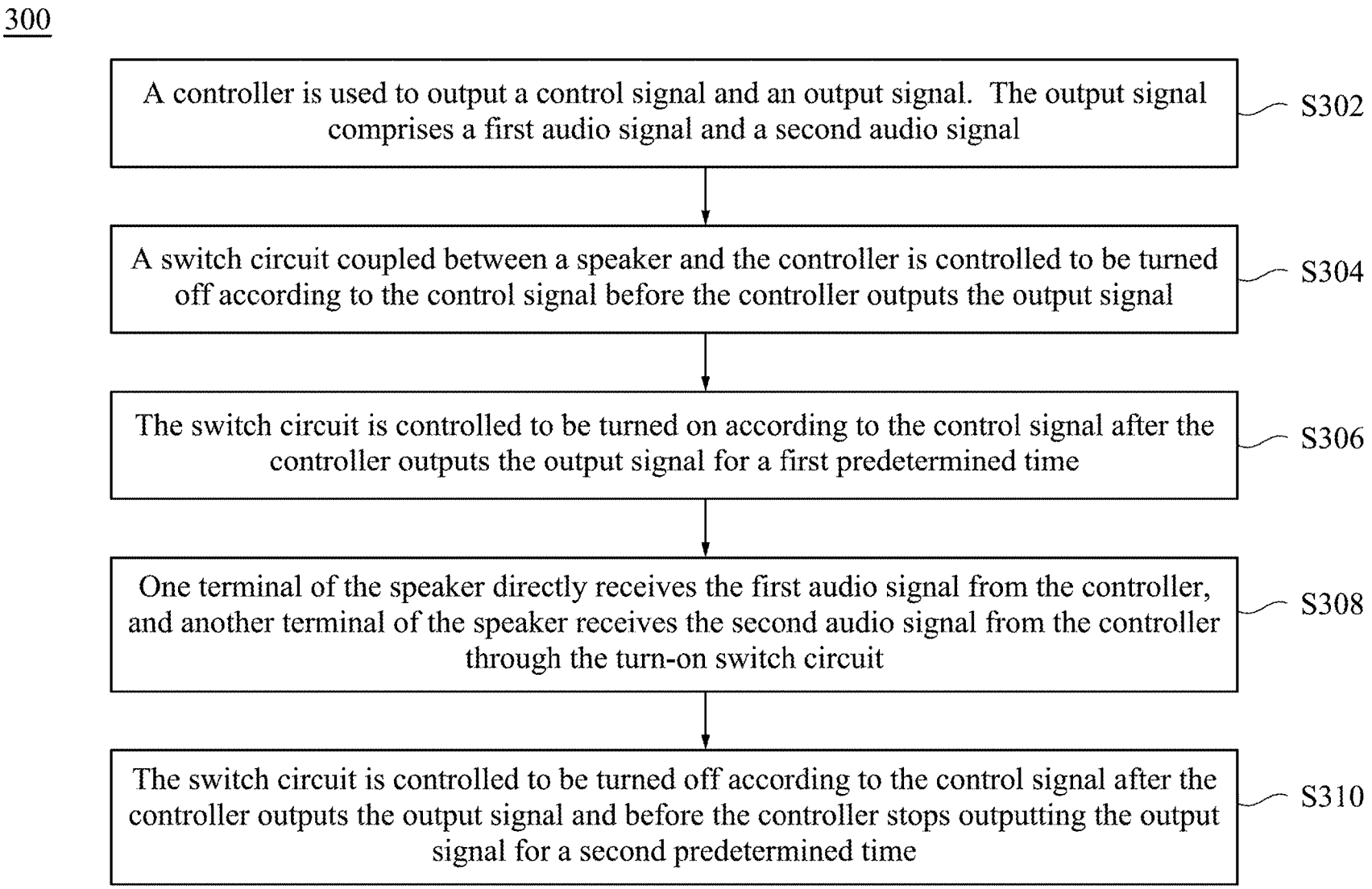
FIG. 3 depicts a flowchart of a control method according to some embodiments of the present disclosure.

A description is provided with reference to FIG. 3. FIG. 3 depicts a flowchart of a control method 300 according to some embodiments of the present disclosure. The control method 300 is applicable to the playback devices 100, 200A, and 200B, and comprises step S302, step S304, step S306, and step S308.

In step S302, a controller is used to output a control signal and an output signal. The output signal comprises a first audio signal and a second audio signal.

In step S304, a switch circuit coupled between a speaker and the controller is controlled to be turned off according to the control signal before the controller outputs the output signal. In some embodiments, the switch circuit 130 is controlled to be turned off according to the control signal CS1 before the controller 120 outputs the audio signal VS1 and the audio signal VS2 to further turn off the switch circuit 140.

In step S306, the switch circuit is controlled to be turned on according to the control signal after the controller outputs the output signal for a first predetermined time. In some embodiments, after the controller 120 outputs the audio signal VS1 and the audio signal VS2 for the first predetermined time, the switch circuit 130 is controlled to be turned on according to the control signal CS1 and the switch circuit 140 is further turned on to avoid pop generated at an instant of outputting the audio signals, which affects the user's listening experience.

In step S308, one terminal of the speaker directly receives the first audio signal from the controller, and another terminal of the speaker receives the second audio signal from the controller through the turn-on switch circuit. In some embodiments, when the switch circuit 130 is turned on, one terminal of the speaker 110 directly receives the audio signal VS1 from the controller 120, and another terminal of the speaker 110 receives the audio signal VS2 from the controller 120 through the turn-on switch circuit 140.

In some embodiments, the control method 300 further comprises step S310. In step S310, the switch circuit is controlled to be turned off according to the control signal after the controller outputs the output signal and before the controller stops outputting the output signal for a second predetermined time. In greater detail, since the controller 120 is likely to generate pop at the instant of outputting signals and at an instant of stopping outputting the signals, the speaker 110 will receive the pop from the controller 120 if a conduction state between the controller 120 and the speaker 110 is maintained at these times, which affects a user. Hence, in some embodiments, after the controller 120 outputs the audio signal VS1 and the audio signal VS2 and before the controller 120 stops outputting the audio signal VS1 and the audio signal VS2 for the second predetermined time (for example: 1 second, but not limited to this, it can be adjusted depending on the control requirements of the earphone system), the switch circuit 130 is controlled to be turned off according to the control signal CS1, so that the switch circuit 140 is turned off accordingly. In this manner, an open circuit can be formed between the speaker 110 and the controller 120 to prevent the speaker 110 from receiving the pop from the controller 120 that is generated at the instant of stopping outputting the signals.

In some embodiments, the control method 300 further comprises using a voltage conversion circuit to provide a negative voltage to the switch circuit, so that a first switch unit in the switch circuit is turned on based on the negative voltage and the control signal, and generates a switching signal. Then, a second switch unit in the switch circuit is turned on based on the switching signal and the first audio signal or the second audio signal. In some embodiments, the voltage conversion circuit 150 is used to provide the output voltage V−, so that the switch circuit 130 is turned on based on the output voltage V− and the control signal CS1 output by the controller 120 and generates the switching signal, and the switch circuit 140 is further turned on based on the switching signal generated by the switch circuit 130 and the audio signal VS1 and/or the audio signal VS2. Since the detailed steps of the above method may be referred to the description of the disposition method of the components in the playback device 100, a description in this regard is not provided here.

In summary, the playback devices 100, 200A, 200B and the control method 300 according to the present disclosure prevent the speaker from receiving the pop generated when the controller activates or deactivates the audio signal output by controlling the switch circuit coupled between the controller and the speaker to be turned on or off. In addition to that, the above function can be achieved with a very small operating current (for example: 220 uA) without causing an increase in power consumption because of its simple component combination.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A playback device comprising:

a speaker having a first terminal and a second terminal;

a controller configured to output a first audio signal, a second audio signal and a control signal, wherein the controller is coupled to the first terminal of the speaker, and configured to transmit the first audio signal to the speaker;

a first switch circuit configured to receive the control signal;

a second switch circuit coupled between the second terminal of the speaker and the controller, and coupled to the first switch circuit, wherein the second switch circuit is configured to receive the second audio signal from the controller and transmit the second audio signal to the speaker when the second switch circuit is turned on; and a voltage conversion circuit configured to provide a negative voltage to the first switch circuit, wherein the second switch circuit is configured to receive the negative voltage when the first switch circuit is turned on by the control signal, and the second switch circuit is turned on according to the negative voltage and the second audio signal.

2. The playback device of claim 1, wherein the first switch circuit is configured to be turned off according to the control signal before the controller outputs the first audio signal and the second audio signal.

3. The playback device of claim 2, wherein the controller is further configured to transmit the control signal to a control terminal of the first switch circuit.

4. The playback device of claim 1, wherein the voltage conversion circuit comprises:

a voltage converter having an input terminal, an output terminal, and a ground terminal, wherein the input terminal of the voltage converter is coupled to a positive input voltage, and configured to convert the positive input voltage into the negative voltage, and outputting the negative voltage to the output terminal of the voltage converter;

a first capacitor coupled between the input terminal and the ground terminal of the voltage converter; and a second capacitor coupled between the input terminal and the output terminal of the voltage converter.

5. The playback device of claim 1, wherein the first switch circuit comprises:

a transistor having a first terminal, a second terminal, and a control terminal, wherein the first terminal of the transistor is coupled to the second switch circuit;

a first resistor coupled between the controller and the control terminal of the transistor; and a second resistor coupled between the control terminal and the second terminal of the transistor.

6. The playback device of claim 1, wherein the second switch circuit comprises;

a first switch;

a second switch connected in reverse series with the first switch at a first node, and a control terminal of the second switch being coupled to a control terminal of the first switch at a second node; and a voltage divider circuit coupled between the first switch and the second switch.

7. The playback device of claim 6, wherein the voltage divider circuit comprises:

a first resistor coupled between the first node and the second node; and a second resistor coupled between the second node and the first switch circuit.

8. A control method comprising:

outputting a control signal and an output signal, by a controller, wherein the output signal comprises a first audio signal and a second audio signal;

controlling a switch circuit coupled between a speaker and the controller to be turned off according to the control signal before the controller outputting the output signal;

providing a negative voltage to the switch circuit, by a voltage conversion circuit;

controlling the switch circuit to be turned on according to the control signal and the negative voltage after the controller outputting the output signal for a first predetermined time;

turning on a first switch unit in the switch circuit based on the control signal to transmit the negative voltage to a second switch unit in the switch circuit;

turning on the second switch unit in the switch circuit based on the negative voltage and the second audio signal; and directly receiving the first audio signal from the controller by one terminal of the speaker, and receiving the second audio signal from the controller through the turn-on switch circuit by another terminal of the speaker.

9. The control method of claim 8, further comprising:

controlling the switch circuit to be turned off according to the control signal after the controller outputting the output signal, and before the controller stopping outputting the output signal for a second predetermined time.

* * * * *